US008562391B2

(12) United States Patent
Roser

(10) Patent No.: US 8,562,391 B2
(45) Date of Patent: Oct. 22, 2013

(54) FINISHING MACHINE WITH STONE ROTATING UNIT

(75) Inventor: Juergen Roser, Haslach (DE)

(73) Assignee: Supfina Grieshaber GmbH & Co. KG, Wolfach (DE)

( * ) Notice: Subject to any disclaimer, the term of this patent is extended or adjusted under 35 U.S.C. 154(b) by 649 days.

(21) Appl. No.: 12/606,855

(22) Filed: Oct. 27, 2009

(65) Prior Publication Data

US 2010/0112913 A1 May 6, 2010

Related U.S. Application Data

(60) Provisional application No. 61/193,312, filed on Nov. 17, 2008.

(30) Foreign Application Priority Data

Nov. 5, 2008 (EP) ..... 08019311

(51) Int. Cl.
*B24B 1/00* (2006.01)

(52) U.S. Cl.
USPC ..... 451/56; 451/65; 451/195

(58) Field of Classification Search
USPC ..... 451/285–290, 362, 56, 65, 195
See application file for complete search history.

(56) References Cited

U.S. PATENT DOCUMENTS

| | | | | |
|---|---|---|---|---|
| 2,026,096 | A * | 12/1935 | Muhlbauer | 451/420 |
| 4,136,489 | A * | 1/1979 | von Allmen | 451/231 |
| 4,226,053 | A * | 10/1980 | Inoue | 451/5 |
| 4,461,121 | A * | 7/1984 | Motzer et al. | 451/5 |
| 4,607,607 | A * | 8/1986 | Janutta et al. | 125/11.03 |
| 5,899,797 | A * | 5/1999 | Junker | 451/62 |
| 6,200,200 | B1 * | 3/2001 | Himmelsbach | 451/62 |
| 6,595,835 | B2 * | 7/2003 | Gadbois | 451/66 |
| 6,685,536 | B1 * | 2/2004 | Junker | 451/5 |

FOREIGN PATENT DOCUMENTS

| | | |
|---|---|---|
| EP | 0 537 107 | 1/1996 |
| GB | 456720 | 11/1936 |

OTHER PUBLICATIONS

EP 08 01 9311 Search Report.

* cited by examiner

*Primary Examiner* — Maurina Rachuba
(74) *Attorney, Agent, or Firm* — Brinks Hofer Gilson & Lione

(57) ABSTRACT

A finishing machine with at least two finishing stones and a stone turning unit is proposed, in which the stone turning unit may be coupled to a rotary drive of the workpiece holder. A separate drive for the stone turning unit may thus be omitted, which results in a reduced weight of the stone turning unit and therefore lower drive power requirement of the stone turning unit and an improved processing quality.

10 Claims, 2 Drawing Sheets

FINISHING MACHINE WITH STONE ROTATING UNIT

CROSS-REFERENCE TO RELATED APPLICATIONS

Figure 1A:
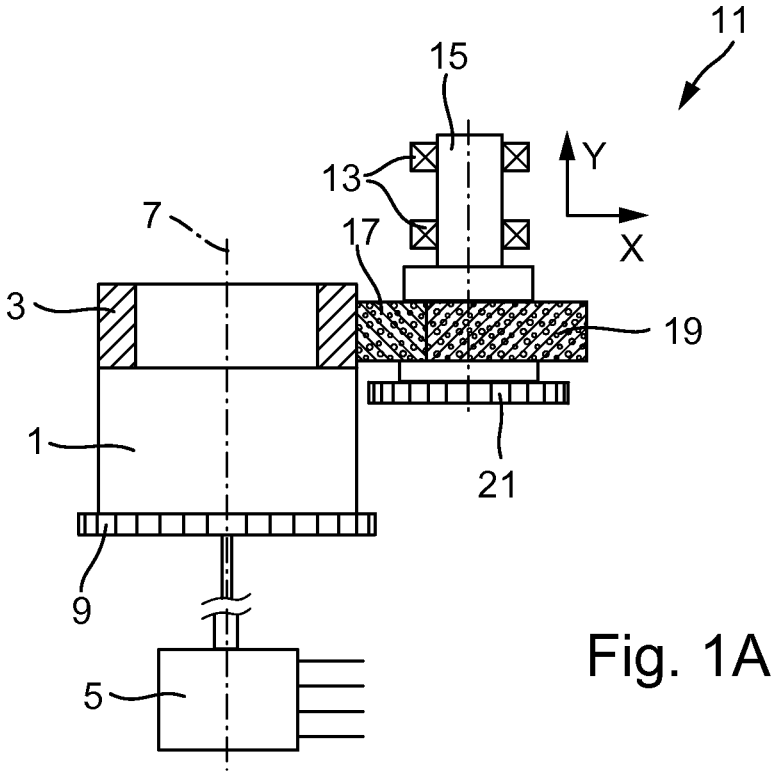

This application claims the benefit of Application Serial No. EP 08019311.3, filed on Nov. 5, 2008, and claims the benefit of U.S. Provisional Application Ser. No. 61/193,312, filed Nov. 11, 2008, the contents of which are incorporated herein by reference in their entirety.

FIELD

The disclosure relates to a finishing machine with stone turning unit.

BACKGROUND

The statements in this section merely provide background information related to the present disclosure and may not constitute prior art.

Finishing machines with several finishing stones are used when the finishing process cannot be completed in one processing step, but prefinishing with a first finishing stone is carried out first and a still finer surface processing is carried out with a second finishing stone. Still further finishing stones may be provided, if necessary.

For these applications the finishing stones are known to be mounted on a stone turning unit and used one after the other to process a workpiece. A drive unit is required for the stone turning unit for this purpose, which serves to position the finishing stone required for the corresponding process in the respectively required position. Drive units are mounted on the stone turning unit in the finishing machines available on the market. A disadvantage of this concept is that this drive unit increases the mass and necessary installation space of the stone turning unit. The mass increase is even more significant when the stone turning unit as well as the finishing stone that is meshing with the workpiece have to perform an oscillating motion while the workpiece is being processed.

This is not only disadvantageous because of the increased drive power requirements, but also because of the need for increased guidance and bedding of the oscillating stone turning unit.

SUMMARY

We disclose a finishing machine available with a stone turning unit, which overcomes the disadvantages known from the state of the art and thus makes a more compact design possible with simultaneously reduced oscillating masses and drive power requirement. A finishing machine according to the principles disclosed herein may have at least two finishing stones, wherein the finishing stones are mounted on a stone turning unit, and wherein the stone turning unit positions one of the finishing stones in such a way that it may be made to mesh with the workpiece to be processed, wherein the workpiece or workpieces to be processed are clamped onto a workpiece holder, and wherein the workpiece holder may be driven by a controllable rotary drive, by coupling the stone turning unit to the rotary drive of the workpiece holder.

By the coupling, if necessary, the stone turning unit to the rotary drive of the workpiece holder, the rotary drive of the workpiece holder, which is provided in any case, may take over an additional function. This function may include turning, if necessary, the stone turning unit to such an extent that the respectively desired finishing stone is moved into processing position. Since exchanging the finishing stones by turning the stone turning unit is carried out only when the workpiece is not being processed, the rotary drive is not fully utilized anyway during this time interval and may take over the new function according to the principles of the disclosure without affecting the efficiency while the workpiece is being processed.

Another advantage may be seen in that the stone turning unit no longer requires a separate drive and is therefore designed smaller and lighter. The rotary drive used to drive the stone turning unit may not follow the movement of the finishing stone and the stone turning unit, so that the stone turning unit according to the disclosure is designed considerably lighter and consequently only causes lower mass forces when it is set into oscillating motion during processing. In this way, drive power is also saved, which may have an effect on the range of application and efficiency of the finishing machine.

In another variation of the disclosure, the stone turning unit is rotatably mounted and comprises a controllable clamping device. In this way, it is possible to couple the rotary drive of the workpiece holder to the stone turning unit when the clamping device is released during periods in which no workpiece is being processed and the stone turning unit may be rotated to such an extent by suitably controlling the rotary drive of the workpiece holder that the desired finishing stone reaches a processing position.

The stone turning unit is subsequently clamped again by controlling the controllable clamping device, so that the stone turning unit cannot be turned while the workpiece is being processed, and the desired finishing stone thus remains meshed with the workpiece to be processed.

A first switchable and controllable coupling according to the disclosure that is carried out between the rotary drive of the workpiece holder and the stone turning unit provides that the rotary drive comprises a first gear wheel, for example a first spur gear, the stone turning unit incorporates a second gear wheel, for example a second spur gear, and that the rotary drive and the stone turning unit are coupled in a way that the first gear wheel and the second gear wheel are caused to mesh with one another.

The angle of rotation, around which the stone turning unit is turned, may be directly determined by detecting the angle of the rotary drive of the workpiece holder and/or the workpiece holder by means of this rigid coupling. A rotary angle sensor of the workpiece holder can thus be used for positioning the stone turning unit. As an alternative, it is also possible to provide a separate rotary angle sensor in the stone turning unit, so that the position of the stone turning unit may be determined independently of the output signal of a rotary angle sensor of the rotary drive of the workpiece holder.

In another variation, the rotary drive and the stone turning unit may be coupled to one another by means of a jaw coupling.

It is also possible to produce a frictional wheel drive, if necessary, that is, a friction-locked coupling between the rotary drive and the stone turning unit. This may be carried out, for example, with a rubberized raceway on the rotary drive, which is pressed against a corresponding cylindrical surface of the stone turning unit.

If the stone turning unit has a separate rotary angle sensor, then a rigid coupling between the rotary drive and the stone turning unit may not be required. Any slip that occurs between the rotary drive and the stone turning unit may become irrelevant, since the control of the rotary drive of the workpiece holder is only interrupted when the stone turning unit has reached the desired position. This position is recorded clearly and with some accuracy via the own rotary angle sensor of the stone turning unit.

A process is also disclosed for exchanging a finishing stone that may be made to mesh with a workpiece to be processed, a finishing machine, wherein at least two finishing stones are mounted on a stone turning unit, wherein the workpiece or workpieces to be processed are clamped onto a workpiece holder and wherein the workpiece holder may be driven by a controllable rotary drive, and wherein the stone turning unit may be coupled to the rotary drive of the workpiece holder, by means of the following exemplary process steps:

Coupling the stone turning unit and the rotary drive, and activating the rotary drive of the workpiece holder, so that a second finishing stone takes the position of a first finishing stone.

This process has the advantages that were already mentioned in connection with the finishing machine according to the disclosed principles, so that reference is made to the descriptions made above in order to avoid repetitions.

In a further variation of the process according to the disclosed principles, processing of the workpiece or workpieces clamped on the workpiece holder is interrupted, while the stone turning unit is coupled to the rotary drive.

The finishing stones may be moved in this way into the desired position without touching the workpiece.

In order to prevent the stone turning unit from rotating relative to the workpiece during processing, the stone turning unit is fixed and/or gripped while the workpiece or workpieces are being processed.

The process, according to the disclosure, is easy to integrate into an already available numerical control of the machine tool and may also comprise more than two finishing stones. If the finishing process is carried out in three steps, a first finishing stone, a second finishing stone, and a third finishing stone for final processing are to be made to mesh with the workpiece to be processed, wherein the above mentioned process is respectively applied.

Further advantages and advantageous variations according to the disclosed principles are apparent from the following drawings, their description, and the patent claims. All features disclosed in the drawings, their description, and the patent claims can each be integrated into a variation of the disclosure individually or in any combination with one another.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1: a side view and top view of a first exemplary variation of a finishing machine according to the principles of the disclosure; and FIG. 2: a second exemplary variation of a finishing machine according to the principles of the disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

FIG. 1*a* shows a side view of a schematic representation of an exemplary variation of a finishing machine according to the disclosed principles, which has been reduced to its parts. The finishing machine has, for example, a workpiece holder 1, onto which a workpiece 3 is clamped. The workpiece 3 is configured, for example, as a cylindrical ring, whose outer lateral surface is finely processed by superfinishing.

The workpiece holder 1 is coupled to a rotary drive 5, which allows the rotation of the workpiece holder 1 and the workpiece 3 clamped thereon around an axis of rotation 7. The rotary drive 5 is coupled via electric lines to a control device (not shown) of the finishing machine and is controlled according to the requirements of the finishing process. A rotary angle sensor, which is not shown, is integrated in the rotary drive 5, and incorporated in the control of the finishing machine.

A first gear wheel in the shape of a spur gear 9 is torque-proof connected to the workpiece holder 1 at the lower end of the workpiece holder 1 in FIG. 1*a*. The first spur gear 9 follows rotary motion of the workpiece holder 1 and/or of the rotary drive 5. A stone turning unit 11 is illustrated on the right side of the workpiece 3 in FIG. 1*a*. The stone turning unit 11 may be rotatably mounted in bearings 13. The bearings 13 may be configured, for example, as deep groove ball bearings or tapered roller bearings.

In addition, the stone turning unit 11 has a controllable clamping device, which is not shown in FIG. 1*a*. This clamping device may be configured, for example, in the shape of a shoe brake as a positive clamping device by means of a radially insertable and removable locking pin, which may be inserted into corresponding grooves and/or recesses (not shown) of the axis 15 of the stone turning unit 11. A first finishing stone 17 and a second finishing stone 19 are arranged on the stone turning unit 11 below the bearing 13. The arrangement of the finishing stones 17 and 19 can be better seen in the plan view according to FIG. 1*b*.

Figure 1B:
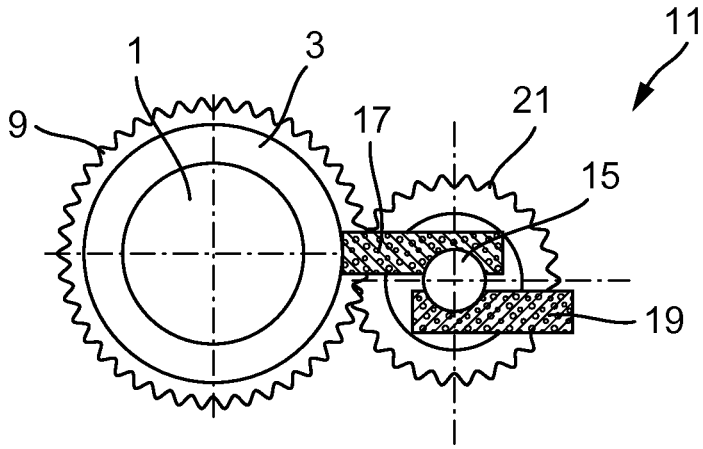

From the plan view, according to FIG. 1*b*, the second finishing stone 19 may be made to mesh with the workpiece 3 when the stone turning unit 11 is rotated 180°.

A second gear wheel, which is configured as a spur gear 21, is arranged for this purpose in FIG. 1*a* at the lower end of the stone turning unit 11. The pitch diameter of the first gear wheel 9 and the second gear wheel 21 as well as the distance between the axis of rotation 7 of the rotary drive and the axis of rotation 23 of the stone turning unit 11 are adjusted in such a way relative to one another that the first gear wheel 9 and the second gear wheel 21 mesh with one another when the stone turning unit 11 is lowered in the direction of the Y axis until the first gear wheel 9 and the second gear wheel 21 are at the same height. Through the displacement and/or movement of the stone turning unit 11 in the direction of the negative Y axis relative to the rotary drive 1 and the workpiece 3 it is also ensured that the finishing stones 17 and 19 do not mesh with the surface of the workpiece 3 to be processed when the gear wheels 9 and 21 are meshed.

When the gear wheels 9 and 21 are meshed, the rotary drive 5 is driven in such a way that the stone turning unit 11 is rotated 180° in the exemplary variation shown in FIG. 1, so that the first finishing stone 17 and the second finishing stone 19 interchange their positions relative to the workpiece 3. The stone turning unit is subsequently again fixed with the clamping device, which is not shown, and is moved upward in the direction of the positive Y axis in FIG. 1*a* until the second finishing stone 19 may be made to mesh with the surface of the workpiece 3 to be processed.

The movement of the second finishing stone 19 toward the workpiece 3 is then carried out by means of a corresponding movement of the stone turning unit in the direction of the negative X axis.

FIGS. 1*a* and 1*b* illustrate that the stone turning unit 11 according to the disclosed principles may be designed very simple, space-saving, and light. This may be advantageous in particular because the stone turning unit 11 and/or the finishing stone 17 or 19, which meshes with the workpiece 3, has to carry out, during processing a workpiece 3, an oscillating motion in direction of the Y axis in order to produce the grinding pattern that is characteristic of superfinishing.

The lighter the stone turning unit is, the lower are the forces required for producing the desired oscillating motion of the stone turning unit 11. At the same time, the mass forces are reduced, which likewise has a positive effect on the processing quality of the workpiece 3.

Instead of the form-fitting coupling described in FIG. 1 between the rotary drive 5 and the stone turning unit 11, also a force-fitting coupling, for example via a rubberized friction gear (not shown) is possible. A rotary angle sensor may be provided on the shaft 15 of the stone turning unit 11, so that the exact position of the stone turning unit and/or of the finishing stones 17 and 19 may be detected by the machine control independently of the slip between the friction gear of the rotary drive 5 and the stone turning unit 11.

Figure 2A:
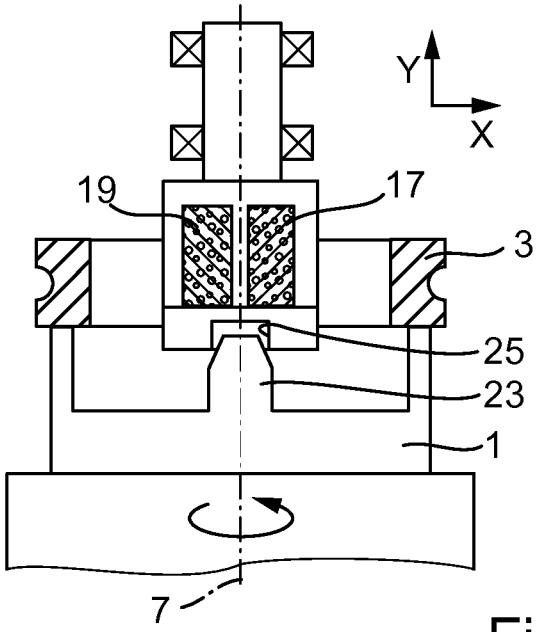
Figure 2B:
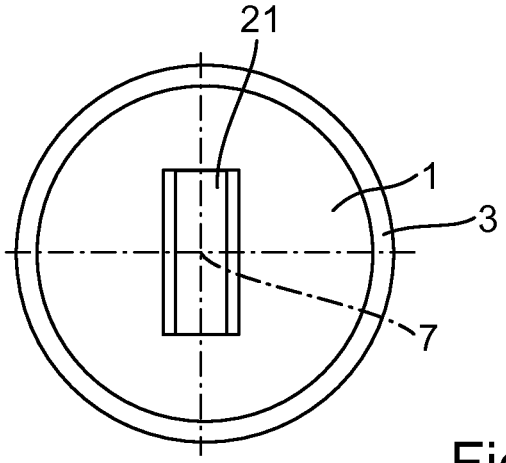

FIG. 2 shows a further exemplary variation of a finishing stone according to principles disclosed. In this exemplary variation, the stone turning unit is arranged in the interior of the cylindrical workpiece 3 and is thus positioned in such a way relative to the rotary drive 5 that the axis of rotation 7 of the rotary drive 5 and the axis of rotation 20 of the stone turning unit run coaxially with respect to one another. The stone turning unit is then lowered in the direction of the negative Y axis in the direction of the rotary drive and/or of the workpiece holder 1 until a positive connection between the rotary drive 5 and/or the workpiece holder 1 and the stone turning unit 11 is generated. In the exemplary variation shown in FIGS. 2*a* and 2*b*, a radially arranged lug 23, which interacts with a correspondingly shaped groove 25 at the lower end of the stone turning unit 11 in the manner of a claw coupling, is provided for this purpose in the workpiece holder 1. In this case, it is also possible to create a force-fitting coupling by means of the friction surface instead of a positive coupling of the stone turning unit 11 and the rotary drive 5.

After the stone turning unit 11 has been turned, it is again raised in the direction of the positive Y axis, so that the coupling between the rotary drive 5 and/or the workpiece holder 1, on the one hand, and the stone turning unit 11 is canceled. One of the two finishing stones 17, 19 is subsequently brought against the meshed surface of the workpiece 3 to be processed. After the coupling of the rotary drive 5 and the stone turning unit has been canceled, the stone turning unit is again clamped and/or locked. The desired finishing stone 17 or 19 is subsequently made to mesh with the surface of the workpiece 3 that is to be processed.

It should be noted that the disclosure is not limited to the variations described and illustrated as examples. A large variety of modifications have been described and more are possible from the disclosed principles. These and further modifications as well as any replacement by technical equivalents may be added to the description and figures, without leaving the scope of the protection of the disclosure and of the present patent.

What is claimed is:

1. A finishing machine with at least two finishing stones, wherein the finishing stones are mounted on a stone turning unit, and wherein the stone turning unit positions one of the finishing stones in such a way that it can be made to mesh with a workpiece to be processed, wherein the workpiece to be processed is clamped onto a workpiece holder, and wherein the workpiece holder is driven by a controllable rotary drive, characterized in that the stone turning unit is rotatably coupled to the rotary drive of the workpiece holder and driven by the rotary drive of the workpiece holder when the workpiece holder is decoupled from the rotary drive.

2. The finishing machine according to claim 1, characterized in that the stone turning unit is rotatably mounted.

3. The finishing machine according to claim 1, characterized in that the stone turning unit comprises a releaseable clamping device.

4. The finishing machine according to claim 1, characterized in that the rotary drive comprises a first gear wheel, the stone turning unit comprises a second gear wheel, and the coupling of the rotary drive and the stone turning unit is carried out by meshing the first gear wheel and the second gear wheel with one another.

5. The finishing machine according to claim 4 characterized in that the first gear wheel is a first spur gear.

6. The finishing machine according to claim 4 characterized in that the second gear wheel is a second spur gear.

7. The finishing machine according to claim 1, characterized in that the rotary drive and the stone turning unit is coupled to one another by means of a claw coupling.

8. A process for changing a finishing stone of a finishing machine, made to mesh with a workpiece to be processed, wherein at least two finishing stones are mounted on a stone turning unit, wherein the workpiece to be processed is clamped onto a workpiece holder, and wherein the workpiece holder is driven by a controllable rotary drive, and wherein the stone turning unit is coupled to the rotary drive of the workpiece holder, characterized by the process steps of coupling the stone turning unit and the rotary drive, driving the rotary drive so that a second finishing stone takes the position of a first finishing stone, and decoupling the turning unit and the rotary drive to bring the second finishing stone into contact with the workpiece.

9. The process according to claim 8, characterized in that the processing of the workpiece clamped on the workpiece holder is interrupted while the stone turning unit is coupled to the rotary drive.

10. The process according to claim 8, characterized in that the stone turning unit is fixed and/or clamped on the workpiece holder while the workpiece is being processed.

* * * * *